United States Patent [19]

Habu et al.

[11] Patent Number: 4,581,327

[45] Date of Patent: Apr. 8, 1986

[54] SILVER HALIDE PHOTOGRAPHIC MATERIAL

[75] Inventors: Takeshi Habu, Hachioji; Akira Kobayashi, Hino, both of Japan

[73] Assignee: Konishiroku Photo Industry Co., Ltd., Tokyo, Japan

[21] Appl. No.: 610,391

[22] Filed: May 15, 1984

[30] Foreign Application Priority Data

May 16, 1983 [JP] Japan ..... 58-84057

[51] Int. Cl.[4] ..... G03C 1/06

[52] U.S. Cl. ..... 430/567; 430/604; 430/608

[58] Field of Search ..... 430/604, 567, 608, 564

[56] References Cited

U.S. PATENT DOCUMENTS

| | | | |
|---|---|---|---|
| 3,488,709 | 1/1970 | Sidebotham | 430/608 |
| 4,070,190 | 1/1978 | Friedrich et al. | 430/567 |
| 4,269,927 | 5/1981 | Atwell | 430/567 |
| 4,346,167 | 8/1982 | Imatomi et al. | 430/608 |
| 4,444,877 | 4/1984 | Koitabashi et al. | 430/567 |
| 4,452,882 | 6/1984 | Akimura et al. | 430/608 |

*Primary Examiner*—Won H. Louie

*Attorney, Agent, or Firm*—Jordan B. Bierman

[57] ABSTRACT

A silver halide photographic material having, in a hydrophilic colloid layer, silver halide grains of a dual structure with core and shell which have been ripened without fogging is disclosed. The outermost shell portion of each of the grains has a silver halide composition such that it contains a rhodium atom and at least 80 mol % of silver chloride. The contents of silver chloride and rhodium in the outermost shell portion of each grain are greater than those for the core.

12 Claims, No Drawings

SILVER HALIDE PHOTOGRAPHIC MATERIAL

BACKGROUND OF THE INVENTION

1. Field of the Invention

The present invention relates to a silver halide photographic material adapted for processing with a lith developer using a hydroquinone compound as the sole developing agent, or an ordinary hard-tone black-and-white developer using both a hydroquinone developing agent and a superadditive developing agent. More particularly, the present invention relates to a high-speed silver halide photographic material having good storage stability and an adequately high tone.

2. Description of the Prior Art

A technique is known in which the interior of a silver halide grain is doped with a rhodium atom in order to provide the former with a hard tone. This method is extensively used because a silver halide photographic material having a desired tone can be obtained by controlling the content of rhodium with which the interior of each silver halide grain is to be doped.

A silver halide photographic material having a rhodium salt doped in the interior of a silver halide grain can be provided with a hard tone, but it often experiences a deterioration in other photographic characteristics, such as reduced sensitivity or becoming soft during storage. In order to eliminate these defects, U.S. Pat. No. 3,488,709 and other prior art references propose the addition of a cadmium salt concurrently with the manufacture of silver halide grains containing a rhodium salt. However, this method is not practically feasible because excess cadmium salt may cause environmental pollution or toxicity to humans not only by being discharged in effluent from the manufacturing line but also by being carried over into the used developer, fixing solution or washings during the processing of a finished photographic material.

In order to solve this problem, Japanese Patent application No. (OPI) 11029/1977 (the symbol OPI as used herein means an unexamined published Japanese patent application) and other prior art references propose stabilizing the cadmium salt by incorporating a compound such as hydroquinone. However, even this method is not capable of permitting the rhodium atom to exhibit its hard tone imparting effect without sacrificing the sensitivity and storage stability, and hence requires a further improvement.

SUMMARY OF THE INVENTION

One object of the present invention is to provide a silver halide photographic material which provides a hard tone and exhibits high storage stability.

Another object of the present invention is to provide a hard-tone and high-speed silver halide photographic material which is protected from increased fog during storage without causing any adverse effects on other photographic characteristics.

These objects of the present invention can be achieved by a silver halide photographic material having, in a hydrophilic colloid layer, silver halide grains of a dual structure with core and shell and which have been ripened without fogging, characterized in that the outermost shell portion of each of said grains has such a silver halide composition that it contains a rhodium atom and at least 80 mol % of silver chloride, the contents of silver chloride and rhodium in the outermost shell portion of each grain being greater than those for the core.

As far as the inventors know, there are two prior art techniques which seem to have some relevance to the basic concept of the present invention. According to one technique, a core-forming silver halide grain is chemically ripened, and a layer of silver halide is deposited on the core so as to form a shell or outer layer, the surface of which is subsequently fogged with a reducing agent (e.g. hydrazine, tin salt or ascorbic acid). The so prepared silver halide grains of dual structure can be used in the manufacture of a silver halide photographic material intended for the formation of a positive image. This method which provides a surface-fogged silver halide grain should be distinguished from the present invention because the former is unable to provide negative acting characteristics without causing fog. The second prior art method which may bear some relevance to the present invention is characterized by doping the core of a silver halide grain with a metal of the group VII of the periodic table, such as iridium, osmium, platinum, rhodium, palladium or ruthenium. However, compounds of these metals are used for the particular purpose of providing improved positive image characteristics or higher adaptability to a large amount of illumination as one requirement for negative image. Therefore, this second method also differs from the present invention with respect to construction and the resulting advantage.

DESCRIPTION OF THE PREFERRED EMBODIMENTS

The silver halide grains incorporated in the photographic material of the present invention have a dual structure in which the core made of a certain silver halide composition is provided with a shell or an outer layer having a different silver halide composition. The shell may be made of silver chlorobromide, silver chloroiodobromide or silver chloride, but it should have a higher silver chloride content than the core and its silver halide composition is such that it has a silver chloride content of at least 80 mol %. At the same time, the core must contain a rhodium atom. Both the core and shell have a silver iodide content of not more than 5 mol %, preferably not more than 2 mol %. The silver iodide content of the core may be different from that of the shell.

The core of each silver halide grain may be directly provided with a shell of silver halide. Alternatively, the two may be separated by an intermediate shell (layer) of silver halide. In this case, the shell of silver halide having the composition specified above forms the outermost layer. The composition of the silver halide in the intermediate shell may be the same as or different from that of the core or the outermost shell. The core may be made of silver bromide, silver chlorobromide or silver chloroiodobromide, and the latter two are preferred.

In order to attain the intended objects of the present invention, silver halide grains are so prepared that the shell of each grain (which is the outermost shell if the intermediate shell is used, and this applies throughout this specification) contains a rhodium atom in a larger amount that the rhodium content in the core.

A rhodium atom in combination with a metallic atom may be incorporated in a silver halide grain by adding them in the form of a desired metal salt (e.g. simple salt, double salt or complex salt) having an alkali metal ion, alkaline earth metal ion or ammonium ion, such as potassium hexachlororhodate, sodium hexachlororhodate or ammonium hexachlororhodate.

The shell preferably contains $1\times10^{-9}$ to $1\times10^{-4}$ mol of rhodium atom per mol of silver halide, and the core contains a smaller amount of rhodium atom, preferably in an amount of $1\times10^{-5}$ mol or less per mol of silver halide.

The silver halide grains forming the core have an average size of 0.02 to 1.0 μm, preferably between 0.05 and 0.6 μm. They preferably have a narrow size distribution such that the deviation from the average size is not more than ±20%. The final average size of completed grains with the shell is generally between 0.05 and 1.5 μm, preferably between 0.1 and 0.8 μm. As in the case of the core, each grain of the dual structure has a narrow size distribution with a deviation not greater than ±20% of the average size.

The core of each grain may contain a noble metal atom such as palladium, iridium, platinum, gold, thallium, copper, lead or osmium. These noble metals may be localized on the surface of each core by precipitation. The preferred content of these noble metal atoms is not more than $1\times10^{-4}$ mol per mol of the silver halide in the core. An optimum amount may be determined in consideration of the species of a particular noble metal atom, the state of each grain and the required characteristics.

The silver halide grains according to the present invention are mixed uniformly in a protective colloid solution under vigorous agitation at a temperature of 35°-80° C. (preferably 50°-70° C.), a pH between 2 and 8 (preferably between 4 and 6.5), and at a pAg of 6-9. The colloid solution contains inactivated gelatin.

The silver halide grains of dual structure according to the present invention may be formed by first producing core grains, then forming a shell layer under controlled temperature, pH and pAg. Alternatively, the core grains are desalted and washed with water before a shell of silver halide is formed under controlled temperature, pH and pAg. The volume ratio of the core to shell may be selected from the range of 1:100 to 100:1, with the range of 1:10 to 10:1 being preferred.

In preparing the core and shell of silver halide grains, the halide is generally used in a 5 to 60% molar excess of the amount of the final silver halide, and a 10 to 40% molar excess is preferred. At least 30 seconds should be used to form the core and shell of silver halide grains, but the period of 60 minutes should not be exceeded. Particularly good results are obtained by continuing the reaction for a period in the range of 1 to 30 minutes.

The silver halide grains of dual structure according to the present invention preferably have such a monodispersity that the deviation from the average particle size is not more than ±20%. The particle size is approximated by the diameter of an equivalent sphere or substantially spherical grain. For cubic particles, their size is calculated as the length of one side multiplied by $\pi/4$. The average particle size may be an algebraic or geometric mean. The deviation as used in this specification means the deviation of the size of each particle from the average size, as devided by the latter and then multiplied by 100.

The rhodium atom incorporated in the silver halide grains in one of the forms shown above may also be present in the form of a rhodium salt of an iodide, bromide, urenated compound or a dye adduct, and water-soluble salts of chloride or bromide are preferred. In order to incorporate a rhodium atom in the silver halide grains using such water-soluble rhodium salts, they are preferably added to either a water-soluble silver salt or a water-soluble halide solution while these two solutions are mixed simultaneously by the "double-jet method". Alternatively, a "triple jet" method may be used wherein the three solutions, i.e., the silver salt solution, halide solution and the solution of the water-soluble rhodium salt are mixed simultaneously to form the desired silver halide grains. For the purpose of incorporating rhodium selectively in the shell, it is desired that said water-soluble rhodium salt be dissolved in the halide solution before the latter is simultaneously mixed with the silver salt solution.

After the formation of silver halide grains with the desired dual structure is completed, the core portion of each grain is ripened with one or more of the sulfur compounds and gold compounds shown below. This ripening is conventionally referred to as chemical ripening and may be readily achieved by methods well known in the photographic industry. Suitable sulfur compounds include sodium thiosulfate, allyl isothiourea, allyl thiourea, phenyl thiourea, thiosemicarbazide, thioacetamide and alkyl thiocarbamate. Suitable gold compounds include sodium tetrachloroaurate, potassium tetrachloroaurate, potassium dibromoaurate, potassium diodoaurate, sodium dichloroaurate, sodium dithiosulfatoaurate and potassium dithiosulfatoaurate. The amount of the respective chemical sensitizers is not limited to any particular value, but for gold compounds, $1\times10^{-8}$ to $1\times10^{-4}$ mol per mol of silver halide is preferred, and for sulfur compounds, $1\times10^{-8}$ to $1\times10^{-4}$ mol per mol of silver halide is preferred. The molar ratio of the two types of compounds is preferably in the range of 1:10 to 10:1. The chemical ripening effected in the present invention using gold and sulfur compounds provides a high surface sensitivity and a low degree of fog, and forms silver-gold sulfides as sensitivity specks. Therefore, this ripening is distinguished both from reduction sensitization and from fog ripening.

The silver halide grains of dual structure according to the present invention are incorporated in a hydrophilic colloid layer which most preferably uses gelatin as a protective colloid or vehicle. Other suitable vehicles are gelatin derivatives and synthetic hydrophilic polymers.

The photographic material of the present invention is prepared by forming on a support at least one silver halide photographic emulsion layer containing the silver halide grains of dual structure shown above. Needless to say, other photographic layers such as a subbing layer, intermediate layers and protective layer may be included in the photographic material. Typical examples of the support include baryta paper, polyethylene-coated paper, synthetic polypropylene paper, glass sheet, cellulose acetate film, cellulose nitrate film, polyester films of, say, polyethylene terephthalate, polyamide film, polypropylene film, polycarbonate film and polystyrene film. A suitable support should be selected from among these examples depending upon the use and object of the final silver halide photographic material.

In order to provide a further improved storage stability, a polyhydroxybenzene compound may be incorporated in the hydrophilic colloid layer. Preferred but by no means limiting examples of the polyhydroxybenzene compound are those which have at least two hydroxyl groups in the benzene ring, provided that the positions other than the hydroxy-substituted sites may have a desired substituent such as a halogen atom, alkyl group, substituted alkyl group, alkoxy group, sulfonic acid group or carboxyl group.

These polyhydroxybenzene compound may be used in varied amounts that depend on the type and use of a specific silver halide photographic material. Generally, they are used in an amount of 0.1 to 30 parts by weight for 100 parts by weight of the hydrophilic colloid. These compounds may be added in a manner similar to that used for adding dyes having an acidic group. If a plurality of non-sensitive layers are used, the polyhydroxybenzene compound incorporated in a hydrophilic colloid layer adjacent to the one containing a dye having an acidic group. Alternatively, said compound and dye may be incorporated in the same hydrophilic colloid layer.

Illustrative Polyhydroxybenzene Compounds:

(1)

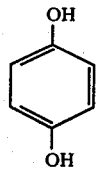

(2)

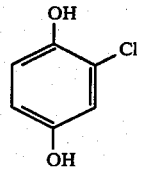

(3)

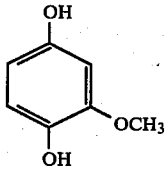

(4)

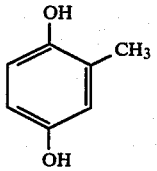

(5)

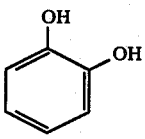

(6)

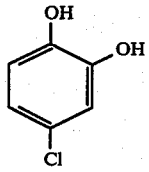

(7)

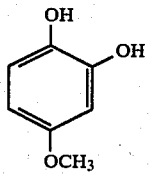

-continued (8)

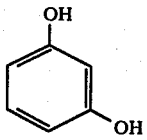

(9)

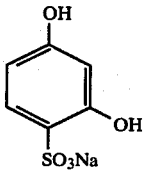

(10)

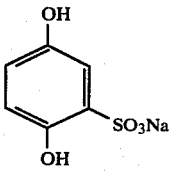

(11)

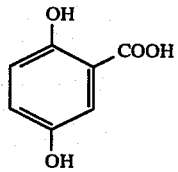

(12)

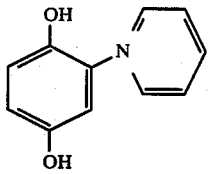

(13)

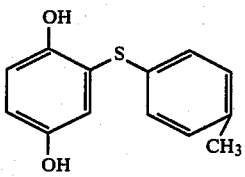

(14)

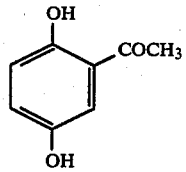

(15)

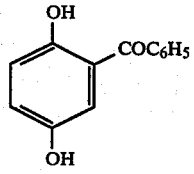

(16)

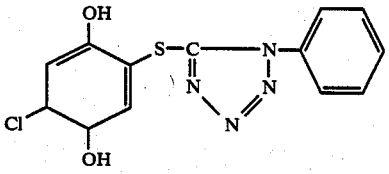

-continued
(17)
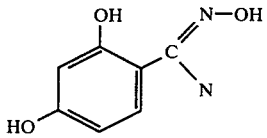
(18)
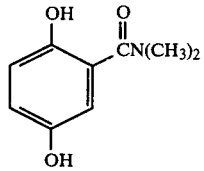
(19)
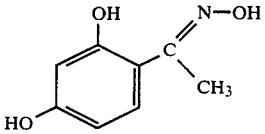
(20)
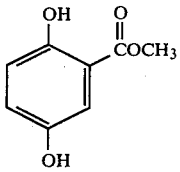
(21)
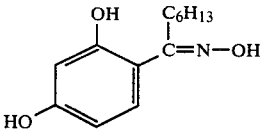
(22)
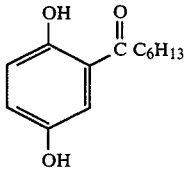
(23)
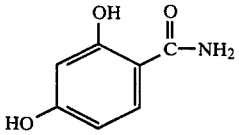
(24)
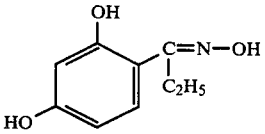
(25)
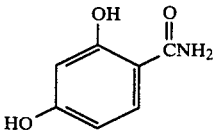
(26)
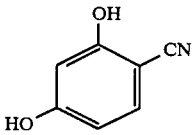
-continued
(27)
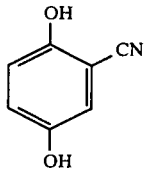
(28)
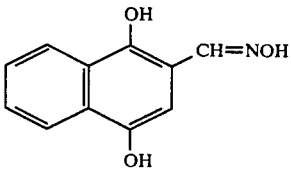
(29)
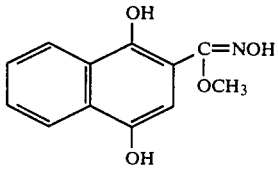
(30)
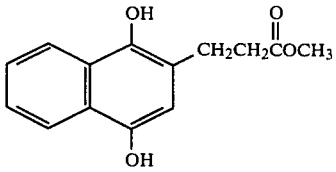
(31)
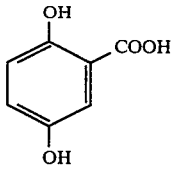
(32)
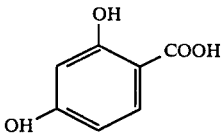
(33)
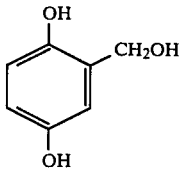
(34)
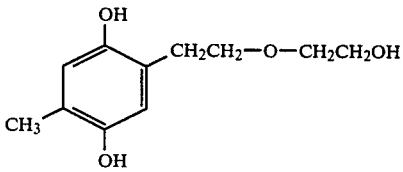
(35)
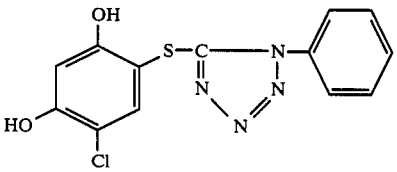

-continued (36)

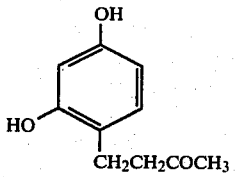

(37)

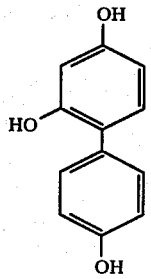

(38)

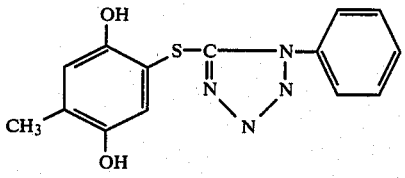

(39)

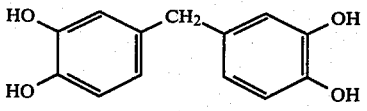

(40)

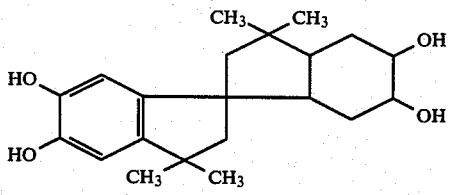

(41)

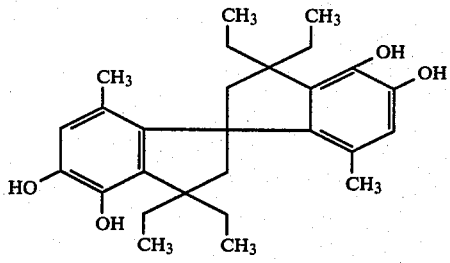

(42)

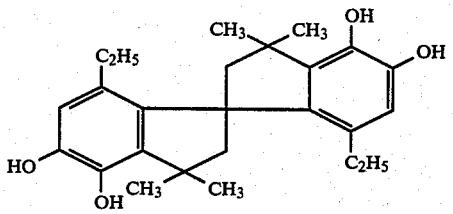

(43)

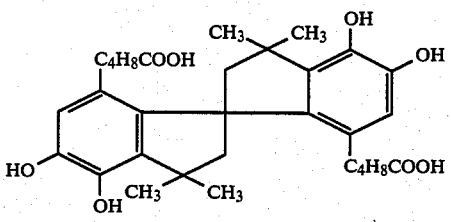

-continued (44)

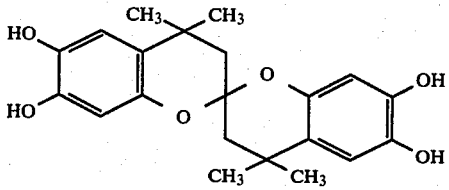

(45)

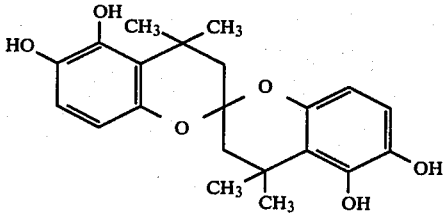

(46)

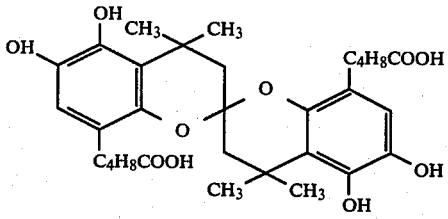

One or more of the sensitizing dyes shown in Japanese Patent application (OPI) No. 17720/1978 may be incorporated in the silver halide emulsion layers used in the present invention. Spectral sensitization using such dyes will provide a higher sensitivity.

The hydrophilic colloid layer containing the silver halide emulsions according to the present invention may also incorporate various photographic additives in the amounts that are not detrimental to the desired objects of the present invention. Examples of suitable additives include gelatin plasticizers, hardeners, surfactants, image stabilizers, UV absorbers, anti-stain agents, pH control agents, antioxidants, antistatic agents, thickeners, granularity improving agents, dyes, mordants, brighteners, development rate modifiers and matting agents.

Thickeners or plasticizers that may be used with particular advantage are styrene-sodium maleate copolymers and dextran sulfate of the type shown in U.S. Pat. No. 2,960,404, Japanese Patent Publication No. 4939/1968, German Patent Publication (DE-AS) No. 1,904,604, Japanese Patent application (OPI) No. 63715/1973, Japanese Patent Publication No. 15462/1970, Belgian Pat. No. 762,833, U.S. Pat. No. 3,767,410 and Belgian Pat. No. 558,143. Preferred hardeners are aldehyde, epoxy, ethyleneimine, active halogen, vinylsulfone, isocyanate, sulfonate ester, carbodiimide, mucochloric acid and acyloyl compounds. Suitable UV absorbers are shown in U.S. Pat. No. 3,253,921 and British Pat. No. 1,309,349 and include 2-(2'-hydroxy-5-tert.-butylphenyl)benzotriazole, 2-(2'-hydroxy-3',5'-di-tert.-butylphenyl)benzotriazole, 2-(2'-hydroxy-3'-tert.-butyl-5'-butylphenyl)-5-chlorobenzotriazole and 2-(2'-hydroxy-3',5'-di-tert.-butylphenyl)-5-chlorobenzotriazole. Suitable dyes are listed in U.S. Pat. No. 2,072,908, German Pat. No. 107,990, U.S. Pat. Nos. 3,048,487 and 515,998. These compounds may be incorporated in the protective layer, emulsion layers or intermediate layers. Coating aids, emulsifiers, agents to improve the permeability to processing solutions, defoaming agents or surfactants for controlling various physical properties of the light-sensitive material may also be used, and as such agents, anionic, cationic, nonionic or amphoteric compounds of the type shown in British Pat. Nos. 548,532 and 1,216,389; U.S. Pat. Nos. 3,026,202 and 3,514,293; Japanese Patent Publication Nos. 26580/1969, 17922/1968, 17926/1968, 13166/1968 and 20785/1973; French Pat. No. 202,588, Belgian Pat. No. 773,459 and Japanese Patent application (OPI) No. 101118/1973 may be used. Compounds suitable for use as antistatic agents are shown in Japanese Patent Publication No. 24159/1971, Japanese Patent application (OPI) No. 89979/1973, U.S. Pat. Nos. 2,882,157 and 2,972,535, Japanese Patent application (OPI) Nos. 20785/1973, 43130/1973 and 90391/1973, Japanese Patent Publication Nos. 24159/1971, 39312/1971 and 43809/1973, as well as Japanese Patent application (OPI) No. 33627/1972. Compounds that can be used as matting agents are listed in British Pat. No. 1,221,980, U.S. Pat. Nos. 2,992,101 and 2,956,884, French Pat. No. 1,395,544 and Japanese Patent Publication No. 43125/1973. Among these compounds, silica gel particles having a size of 0.5 to 20 μm and polymers such as polymethyl methacrylate having a particle size of 0.5 to 20 μm are particularly preferred.

The photographic material of this invention is suitable for processing with a lith developer using a hydroquinone compound as the sole developing agent, or an ordinary hardtone black-and-white developer using both a hydroquinone developing agent and a superadditive developing agent.

The following developing agents may be incorporated in the developer to be applied to the processing of the photographic material of the present invention:

$HO—(CH{=}CH)_n—OH$ type developer: Typically catechol, pyrogallol, their derivatives, and ascorbic acid. Specific examples are hydroquinone, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 2,5-dihydroxyacetophenone, 2,5-diethylhydroquinone, 2,5-di-p-phenetylhydroquinone, 2,5-dibenzoylaminohydroquinone, catechol, 4-chlorocatechol, 3-phenylcatechol, 4-phenyl-catechol, 3-methoxycatechol, 4-acetyl-pyrrogallol, 4-(2'-hydroxybenzoyl)-pyrogallol, and sodium ascorbate.

$HO—(CH{=}CH)_n—NH_2$ type developer: Typically ortho- and paraaminophenol and aminopyrazolone. Specific examples include 4-aminophenol, 2-amino-6-phenylphenol, 2-amino-4-chloro-6-phenylphenol, 4-amino-2-phenylphenol, 3,4-diaminophenol, 3-methyl-4,6-diaminophenol, 2,4-diaminoresorcinol, 2,4,6-triaminophenol, N-methyl-p-aminophenol, N-β-hydroxyethyl-p-aminophenol, p-hydroxyphenylaminoacetic acid and 2-aminonaphthol.

$H_2N—(C{=}C)_n—NH_2$ type developer: Typical examples include 4-amino-2-methyl-N,N-diethylaniline, 2,4-diamino-N,N-diethylaniline, N-(4-amino-3-methylphenyl)-morpholine, p-phenylenediamine, 4-amino-N,N-dimethyl-3-hydroxyaniline, N,N,N',N'-tetramethylparaphenylenediamine, 4-amino-N-ethyl-N-(β-hydroxyethyl)-aniline, 4-amino-3-methyl-N-ethyl-N-(β-hydroxyethyl)-aniline, 4-amino-N-ethyl-(β-methoxyethyl)-3-methyl-aniline, 4-amino-3-methyl-N-ethyl-N-(β-methylsulfonamidoethyl)-aniline, 4-amino-N-butyl-N-γ-sulfobutylaniline, 1-(4-aminophenyl)-pyrrolidine, 6-amino-1-ethyl, 1,2,3,4-tetrahydroquinoline and 9-aminojurolideine.

Hetero ring type developer: Typical examples are 1-phenyl-3-pyrazolidone(Phenidone), 1-phenyl-4-amino-5-pyrazolone, 1-(p-aminophenyl)-3-amino-2-pyrazoline, 1-phenyl-3-methyl-4-amino-5-pyrazolone, 4,4'-dimethyl-1-phenylpyrazolidone (Dimezone), 5-aminouracil, and 5-amino-2,4,6-trihydroxyphyrimidine.

Other developing agents that may be used with advantage in the present invention are shown in T. H. James; "The Theory of the Photographic Process", 4th Ed., pp. 291–334, and Journal of the American Chemical Society, 73, 3100 (1951). These and above listed developing agents may be used alone but more preferably, they are used in combination. Preferred combinations are that of hydroquinone and Phenidone, and that of hydroquinone and Dimezone. Advantageously, hydroquinone is used in an amount ranging from 5 to 50 g/1,000 ml, whereas Phenidone or Dimezone is used in an amount ranging from 0.05 to 5 g/1,000 ml. One advantage of the present invention is that the developer permits the use of a preservative made of sulfites such as sodium sulfite, potassium sulfite and ammonium sulfite. The advantageous concentration of these sulfites ranges from 0.06 to 1 gr. ion/1,000 ml. Other compounds that may be used as preservatives are hydroxylamine and hydrazide compounds. As in ordinary hard-tone black-and-white developers, caustic alkalis, alkali carbonates or amine may optionally be used for pH control and buffering purposes. Furthermore, the developer used in the present invention may contain the following additives: inorganic development retarders (e.g. potassium bromide), metal ion sequestering agents (e.g. ethylenediaminetetraacetic acid), development accelerators (e.g. methanol, ethanol, benzyl alcohol and polyalkylene oxide), surfactants (e.g. sodium alkylarylsulfonate, natural saponin, sugars, and alkyl esters of the compounds listed above), hardeners (e.g., glutaraldehyde, formalin and glyoxal), and ionic strength modifier (e.g. sodium sulfate). The pH of the developer can be adjusted to any value between 9 and 12, and from a viewpoint of preservability and photographic performance, the range of 10 to 11 is preferred.

The developer may also contain an organic solvent such as alkanolamines or glycols. Suitable alkanolamines are monoethanolamine, diethanolamine and triethanolamine, with triethanolamine being preferred. These alkanolamines are used in preferred amounts between 20 and 500 g/1,000 ml of the developer, and the range of 60 to 300 g/1,000 ml of the developer is particularly preferred. Suitable glycols include ethylene glycol, diethylene glycol, propylene glycol, triethylene glycol, 1,4-butanediol and 1,5-pentanediol, with diethylene glycol being preferred. These glycols are used in preferred amounts ranging from 20 to 500 g/1,000 ml of the developer, and the range of 60 to 300 g/1,000 ml of the developer is particularly preferred. These alkanolamines and glycols may be used either alone or in combination with themselves.

The developer may further contain a development retarder such as 5-nitroindazole, 6-nitroindazole, 5-methylbenzotriazole, 6-methylbenzotriazole, 5-nitrobenzimidazole, and 1-phenyl-5-mercaptotetrazole. These retarders are used in preferred amounts ranging from $1\times10^{-1}$ to $1\times10^{-5}$ mol/1,000 ml of the developer, and the range of $1\times10^{-2}$ to $1\times10^{-4}$ mol/1,000 mol of the developer is particularly preferred. These retarders are preferably added to the developer after being dissolved in alkanolamines or glycols.

The photographic material of the present invention may be processed under various conditions. The preferred processing temperature is not more than 50° C., and temperatures about 30° C. are particularly preferred. The processing is usually completed within 3 minutes, and in most cases, good results are obtained by processing for a period of less than 2 minutes. The development may be combined with other processing steps such as washing, stopping, stabilization, fixing, as well as prehardening and neutralization. Some of these optional steps may be omitted. The photographic material of the present invention may be processed either manually (as in vat development or frame development) or mechanically (as in roller development or hanger development).

The advantages of the present invention will become apparent by reading the following examples to which the scope of the invention is by no means limited.

EXAMPLE 1

Preparation of Comparative Emulsion (EM-1)

| | | |
|---|---|---|
| Solution A: | Water | 3,500 ml |
| | Inactivated gelatin | 133 g |
| Solution B: | Water | 5,100 ml |
| | Inactivated gelatin | 33 g |
| | Sodium chloride | 284 g |
| | Potassium bromide | 244 g |
| | 0.01% aq. sol. of potassium hexachlororhodate | 10 ml |
| Solution C: | Water | 5,100 ml |
| | Silver nitrate | 1,000 g |

To solution A which was being heated at 65° C., solutions B and C held at 60° C. were added simultaneously over a period of 4 minutes. Following agitation for another 10 minutes, 1,200 ml of 20% aq. sol. of magnesium sulfate and 1,500 ml of 5% aq. sol. of polynaphthalenesulfonic acid were added. The resulting emulsion was flocculated at 40° C., decanted, and washed with water to remove excess water-soluble salt. The residue was dispersed first in 2,200 ml of water, then in 166 g of inactivated gelatin. As a result, grains having an average size of 0.25 μm and consisting of 35 mol % silver bromide and 65 mol % silver chloride were obtained.

The emulsion was mixed with 80 ml of 0.1% aq. sol. of sodium thiosulfate, 80 ml of 0.2% aq. sol. of chloroauric acid and 100 ml of 1% aq. sol. of potassium iodide, and the mixture was held at a pH of 5.5–6.5 and a temperature of 50°–60° C. in order to ripen the emulsion chemically to provide a maximum sensitivity.

To the ripe emulsion, 830 ml of 1% methanol solution of 4-hydroxy-6-methyl-1,3,3a,7-tetraazaindene, 1.7 g and 0.5 g of sensitizing dyes (a) and (b) (for their respective structures, see below), 100 ml of a surfactant (20% aq. sol. of saponin), 166 ml of a thickener (4% aq. sol. of styrenemaleic acid copolymer), 1.7 g of a development accelerator (polyethylene glycol with a mol. wt. of 3,000), 0.7 g of an antifoggant (1-phenyl-5-mercaptotetrazole), and hardeners (mucochloric acid and glyoxal) were added. The mixture was applied to a subbed poly(ethylene terephthalate) film base to give a silver deposit of 3.5 g/m$^2$ and a gelatin deposit of 2 g/m$^2$. The web was exposed to a tungsten light (320 CMS) through an optical wedge and processed in a developer whose formulation is indicated below.

Preparation of Emulsion of the Present Invention (EM-2)

| | | |
|---|---|---|
| Solution A: | Water | 3,500 ml |
| | Inactivated gelatin | 133 g |
| Solution B: | Water | 2,600 ml |
| | Inactivated gelatin | 16 g |
| | Sodium chloride | 80 g |
| | Potassium bromide | 243 g |
| Solution C: | Water | 2,600 ml |
| | Silver nitrate | 500 g |
| Solution D: | Water | 2,600 ml |
| | Inactivated gelatin | 16 g |
| | Sodium chloride | 200 g |
| | 0.01% aq. sol. of potassium hexachlororhodate | 10 ml |
| Solution E: | Water | 2,600 ml |
| | Silver nitrate | 500 g |

To solution A which was being heated at 65° C., solutions B and C held at 60° C. were added simultaneously over a period of 2 minutes. Following a 5-minute ripening under agitation, solutions D and E held at 60° C. were added simultaneously over a period of 2 minutes. Following ripening for another 10 minutes, 1,200 ml of 20% aq. sol. of magnesium sulfate and 1,500 ml of 5% aq. sol. of polynaphthalenesulfonic acid were added. The resulting emulsion was flocculated at 40° C., decanted and washed with water to remove excess water-soluble salt. The residue was dispersed first in 2,200 ml of water, then in 166 g of inactivated gelatin. As a result, grains having an average size of 0.25 μm and consisting of 35 mol % silver bromide and 65 mol % silver chloride were obtained. The shell of each grain consisted of rhodium-doped silver chloride. The core to shell volume ratio was 1:1. The results of photographic processing applied to samples (No. 1 and No. 2) using the EM-1 and EM-2 grains are shown in Table 1.

Formulation of developer

| Components | Amount |
|---|---|
| Pure water | 500 ml |
| Ethylenediaminetetraacetic acid disodium salt | 2 g |
| 50% aq. sol. of potassium sulfite | 90 ml |
| Hydroquinone | 20 g |
| 1-Phenyl-4,4-dimethyl-3-pyrazolidone | 0.3 g |
| Potassium carbonate | 50 g |
| 5-Methylbenzotriazole | 20 mg |
| 5-Nitroindazole | 20 mg |
| 1-Phenyl-5-mercaptotetrazole | 30 mg |
| Diethylene glycol | 50 g |

The following processing protocol was used. In the fixing step, a commerical fixing agent for rapid processing was employed.

| | | |
|---|---|---|
| Development | 43° C. | 20 sec. |
| Fixing | 35° C. | 20 sec. |
| Washing | 25° C. | 20 sec. |
| Drying | 40° C. | 20 sec. |

The following two sensitizing dyes were added to each emulsion.

(a)

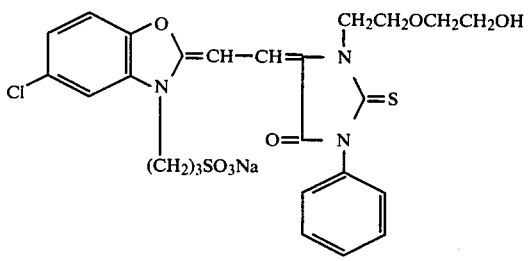

(b)

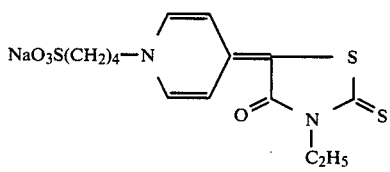

Seventeen more emulsions were prepared by varying the amounts of water-soluble halides and water-soluble rhodium salt. The compositions of the resulting emulsions are shown in Table A below. Photographic material samples were prepared using these emulsions and their sensitometric data is also shown in Table 1.

TABLE A

| Sample No. | Composition of core: Halide composition (mol %) AgCl | AgBr | AgI | Rhodium content (mol/mol silver) | Composition of shell: Halide composition (mol %) AgCl | AgBr | AgI | Rhodium content (mol/mol silver) | Core/Shell Volume Ratio |
|---|---|---|---|---|---|---|---|---|---|
| 1 | 65 | 35 | 0.1 | $6 \times 10^{-7}$ | | the same as core | | | single sturcture |
| 2 | 85 | 15 | 0.1 | $6 \times 10^{-7}$ | | the same as core | | | |
| 3 | 95 | 15 | 0.1 | $6 \times 10^{-7}$ | | the same as core | | | |
| 4 | 30 | 70 | — | — | 99.5 | — | 0.5 | $1.2 \times 10^{-6}$ | 1/1 |
| 5 | 30 | 70 | — | $1.2 \times 10^{-6}$ | 99.5 | — | 0.5 | — | 1/1 |
| 6 | 30 | 70 | — | — | 90 | 9.5 | 0.5 | $1.2 \times 10^{-6}$ | 1/1 |
| 7 | 30 | 70 | — | — | 85 | 14.5 | 0.5 | $1.2 \times 10^{-6}$ | 1/1 |
| 8 | 29.5 | 70 | 0.5 | — | 70 | 29.5 | 0.5 | $1.2 \times 10^{-6}$ | 1/1 |
| 9 | 19.5 | 80 | 0.5 | $1.2 \times 10^{-8}$ | 99.5 | — | 0.5 | $1.2 \times 10^{-6}$ | 1/2 |
| 10 | 9.5 | 90 | 0.5 | $1.2 \times 10^{-8}$ | 99.5 | — | 0.5 | $1.2 \times 10^{-6}$ | 1/5 |
| 11 | 40 | 60 | — | $1.2 \times 10^{-8}$ | 90 | 9.5 | 0.5 | $1.2 \times 10^{-6}$ | 2/3 |
| 12 | 40 | 60 | — | $1.2 \times 10^{-8}$ | 85 | 14.5 | 0.5 | $1.2 \times 10^{-6}$ | 2/3 |
| 13 | 40 | 60 | — | $1.2 \times 10^{-8}$ | 70 | 29.5 | 0.5 | $1.2 \times 10^{-6}$ | 2/3 |
| 14 | 29.8 | 70 | 0.2 | — | 99.5 | — | 0.5 | $1.2 \times 10^{-6}$ | 2/1 |
| 15 | 29.2 | 70 | 0.8 | — | 99.5 | — | 0.2 | $1.2 \times 10^{-6}$ | 2/1 |
| 16 | 29 | 70 | 1.0 | — | 99.5 | — | 0.2 | $1.2 \times 10^{-6}$ | 2/1 |
| 17 | 40 | 59.5 | 0.5 | $1.2 \times 10^{-6}$ | 90 | 10 | — | $1.2 \times 10^{-8}$ | 1/1 |
| 18 | 40 | 59.5 | 0.5 | $1.2 \times 10^{-6}$ | 85 | 15 | — | $1.2 \times 10^{-8}$ | 1/1 |
| 19 | 40 | 59.5 | 0.5 | $1.2 \times 10^{-6}$ | 70 | 30 | — | $1.2 \times 10^{-8}$ | 1/1 |

TABLE 1

| Sample No. | As freshly coated: Sensitivity | Fog | Contrast | After storage: Sensitivity | Fog | Contrast |
|---|---|---|---|---|---|---|
| 1 | 100 | 0.05 | 3.8 | 60 | 0.20 | 2.5 |
| 2 | 95 | 0.06 | 3.7 | 55 | 0.21 | 2.4 |
| 3 | 90 | 0.07 | 3.5 | 55 | 0.22 | 2.3 |
| 4 | 150 | 0.04 | 4.5 | 151 | 0.05 | 4.5 |
| 5 | 95 | 0.05 | 3.7 | 50 | 0.20 | 2.4 |
| 6 | 148 | 0.04 | 4.5 | 150 | 0.05 | 4.5 |
| 7 | 149 | 0.04 | 4.4 | 153 | 0.05 | 4.4 |
| 8 | 95 | 0.07 | 3.5 | 70 | 0.15 | 2.5 |
| 9 | 150 | 0.04 | 4.5 | 148 | 0.05 | 4.5 |
| 10 | 152 | 0.04 | 4.5 | 152 | 0.04 | 4.5 |
| 11 | 153 | 0.04 | 4.5 | 151 | 0.05 | 4.5 |
| 12 | 148 | 0.04 | 4.5 | 150 | 0.05 | 4.4 |
| 13 | 105 | 0.07 | 3.5 | 60 | 0.17 | 2.5 |
| 14 | 162 | 0.04 | 4.5 | 160 | 0.05 | 4.4 |
| 15 | 168 | 0.04 | 4.4 | 170 | 0.05 | 4.5 |
| 16 | 170 | 0.04 | 4.5 | 172 | 0.05 | 4.4 |
| 17 | 96 | 0.05 | 3.8 | 55 | 0.18 | 2.5 |
| 18 | 95 | 0.05 | 3.8 | 60 | 0.16 | 2.4 |
| 19 | 96 | 0.05 | 3.8 | 58 | 0.18 | 2.3 |

In Table 1, the contrast is indicated by a gamma value corresponding to the exposures providing densities of 0.2 and 1.5. The stability test consisted of holding a web for 12 hours at 25° C. and 50% r.h., packaging the web in an air-tight container, and exposing it to extreme conditions in a constant-temperature chamber (50° C.) for 30 days. The so treated web was processed and its photographic properties were compared with those processed immediately after preparation.

As is clear from Table 1, the samples according to the present invention (Nos. 4, 6, 7, 9–12, 14–16) could provide a harder tone than the comparatives samples (Nos. 1–3, 5, 8, 13, 17–19) for an extended period without sacrificing other photographic characteristics.

What is claimed is:

1. A silver halide photographic material having, in a hydrophilic colloid layer, silver halide grains of a dual structure with core and shell which have been ripened without fogging, wherein the outermost shell portion of each of said grains has such a silver halide composition that it contains a rhodium atom and at least 80 mol % of silver chloride, the contents of silver chloride and rhodium in the outermost shell portion of each grain being greater than those for the core.

2. A silver halide photographic material according to claim 1, wherein said shell is made of silver chlorobromide, silver chloroiodobromide or silver chloride.

3. A silver halide photographic material according to claim 1, wherein said core and shell have a silver iodide content of not more than 5 mol %.

4. A silver halide photographic material according to claim 3, wherein said core and shell have a silver iodide content of not more than 2 mol %.

5. A silver halide photographic material according to claim 1, wherein said core is made of silver bromide, silver chlorobromide or silver chloroiodobromide.

6. A silver halide photographic material according to claim 1, wherein said shell contains $1 \times 10^{-9}$ to $1 \times 10^{-4}$ mol of rhodium atom per mol of silver halide.

7. A silver halide photographic material according to claim 1, wherein said core has an average grain size of 0.02 to 1.0 μm.

8. A silver halide photographic material according to claim 7, wherein said core has an average grain size of 0.05 to 0.6 μm.

9. A silver halide photographic material according to claim 1, wherein said silver halide grains of dual structure have an average size of 0.05 to 1.5 μm.

10. A silver halide photographic material according to claim 9, wherein said silver halide grains of dual structure have an average size of 0.1 to 0.8 μm.

11. A silver halide photographic material according to claim 1, wherein the volume ratio of said core to shell is in the range of 1:100 to 100:1.

12. A silver halide photographic material according to claim 11, wherein said volume ratio is in the range of 1:10 to 10:1.

* * * * *